US007000281B1

(12) United States Patent
Morad

(10) Patent No.: US 7,000,281 B1
(45) Date of Patent: Feb. 21, 2006

(54) PUSH BROOM WHICH IS CONVERTIBLE TO A HANDHELD WHISK BROOM

(75) Inventor: Fred I. Morad, Toluca Lake, CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 0 days.

(21) Appl. No.: 10/782,418

(22) Filed: Feb. 17, 2004

(51) Int. Cl.
*A47L 13/12* (2006.01)
*A48B 5/00* (2006.01)

(52) U.S. Cl. ..... 15/106; 15/159.1; 15/160; 15/176.1; 15/202

(58) Field of Classification Search ..... 15/106, 15/105, 159.1, 160, 171, 172, 176.1, 176.6, 15/202
See application file for complete search history.

(56) References Cited

U.S. PATENT DOCUMENTS 3,134,129 A * 5/1964 Allen ..... 401/138
5,517,710 A * 5/1996 Hisey ..... 15/106
6,571,416 B1 * 6/2003 Hirse ..... 15/106

FOREIGN PATENT DOCUMENTS

FR 2224113 * 10/1974
GB 0493802 * 10/1938

* cited by examiner

*Primary Examiner*—John Kim
*Assistant Examiner*—Laura C Cole
(74) *Attorney, Agent, or Firm*—Thomas I. Rozsa; Tony D. Chen

(57) ABSTRACT

A convertible broom which has two sections each retaining a multiplicity of bristles on their respective lower surfaces. The two sections have means to retain them together and when in this condition, the joined sections can be used as a conventional straight broom or angle broom with the sections pushed or swept by an elongated handle retained in the first section. The two sections can also be separated and the second section which has a short handle retained thereon or grasping means incorporated therein can then be used as a handheld whisk broom.

2 Claims, 2 Drawing Sheets

56
30
34
32
42
38
36
10
20
34
32
38
36

94
64
60
69
80
62
86
90
46
88
84
68
66
65
82
67
92
76
74
72
78
70
54
52
40
44
48
50

PUSH BROOM WHICH IS CONVERTIBLE TO A HANDHELD WHISK BROOM

BACKGROUND OF THE INVENTION

1. Field of the Invention

The present invention relates to the field of brooms, and in particular push brooms and handheld whisk brooms.

2. Description of the Prior Art

Brooms in general are old and well known in the art. Push brooms are known and handheld whisk brooms are known. However, no embodiment known to the present inventor incorporates the concept of a convertible broom where a push broom and a whisk broom are incorporated into the same device.

SUMMARY OF THE INVENTION

The present invention is a convertible broom which has two sections each retaining a multiplicity of bristles on their respective lower surfaces. The two sections have means to retain them together and when in this condition, the joined sections can be used as a conventional straight broom or angle broom with the sections pushed or swept by an elongated handle retained in the first section. The two sections can also be separated and the second section which has a short handle retained thereon or grasping means incorporated therein can then be used as a handheld whisk broom.

It is therefore an object of the present invention to create a convertible broom which can be used as a conventional broom and also can be separated so a portion of the apparatus can be used as a handheld whisk broom.

It is also an object of the present invention to utilize the conversion feature so the broom can be used as a conventional broom and also separated so that a portion can be used as a whisk broom for both an angled broom and also a straight broom.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figures 1, 2:
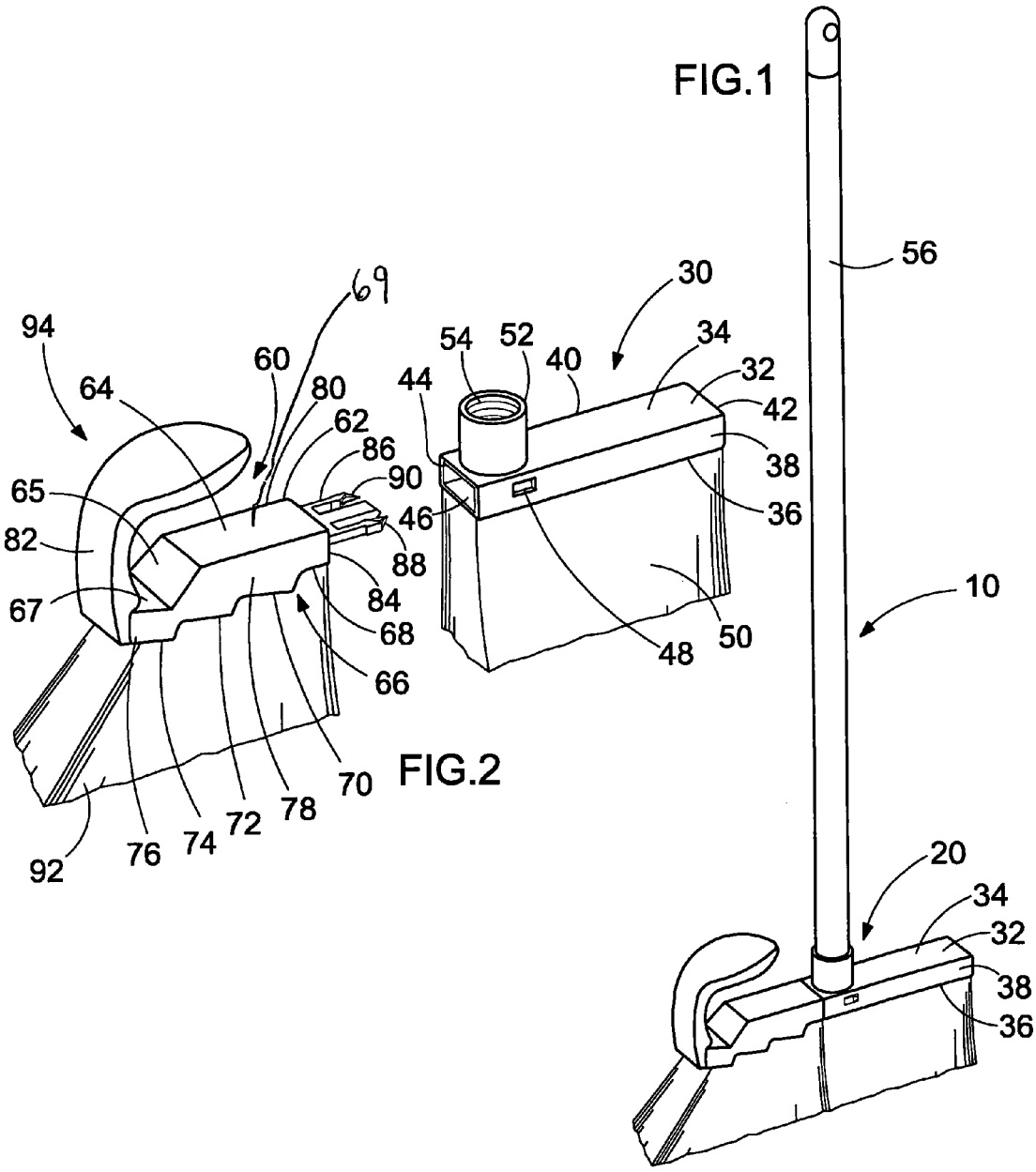
FIG. 1 is a perspective view of the present invention convertible broom embodied in an angled push broom.
FIG. 2 is a is a perspective view of the separated sections of the embodiment of the convertible broom illustrated in FIG. 1, with the sections separated so that one section is used as a handheld angled whisk broom.

The first embodiment of the present invention convertible broom is incorporated into an angled broom illustrated in FIGS. 1 and 2. The convertible angle broom 10 includes a two piece housing 20 having a first section 30 and a second section 60. First section 30 includes an elongated housing portion 32 having an upper surface 34, a lower surface 36, a first sidewall 38, a parallel second sidewall 40, a first closed outward end 42 and a parallel open interior second end 44, the open end 44 leading to an internal chamber 46, with a first open slot 48 formed in said first sidewall 38 and leading to said internal chamber 46 and a corresponding parallel open slot in second sidewall 40, the corresponding parallel open slot also leading to internal chamber 46. The lower surface 36 of housing portion 32 retains a multiplicity of straight bristles 50 within the lower surface 36. The upper surface 34 of housing portion 32 supports a handle base 52 having threaded receiver means 54 to receive the lower end of the broom handle 56.

Second section 60 of two piece housing 20 includes an elongated stepped housing portion 62 having an upper surface 64 and a stepped lower surface 66 having a multiplicity of step sections. In the embodiment illustrated in FIGS. 1 and 2 there are four stepped sections 68, 70, 72 and 74 in lower surface 66 with each successive stepped section formed at a greater angle to the horizontal upper surface 64 than the preceding stepped sections. The upper surface 64 is initially horizontal at the innermost portion 69 of second section 60 and then tapers at angle portion 65 until it once again converts to an outermost horizontal portion 67 against its outward end 76, the outermost horizontal portion 67 positioned lower than the innermost horizontal portion 69. Second section housing portion 62 also has a first sidewall 78, a parallel oppositely disposed second sidewall 80.

Formed onto outward end 76 is a handle 82. The handle has an arcuate configuration so that a portion of the handle 82 extends over the upper surface of second section housing 62, including over surfaces 65 and 67 and partially over surface 64.

Oppositely disposed interior end 84 of housing 62 supports a horizontally disposed male mating member 86 which has male clips to mate with the open slots in housing portion 32 of first section 30. In operation, male mating member 86 is inserted into internal chamber 46 of housing portion 32 so that first mating clip 88 protrudes through first open slot 48 and second mating clip 90 protrudes through the corresponding second open slot in second parallel sidewall 40.

The stepped sections 68, 70, 72 and 74 of stepped lower surface 66 support a multiplicity of bristles 92 which initially are straight at the innermost portion of stepped section 66 which rests adjacent the first section, with the bristles extending at ever greater angles to the horizontal as the bristles are positioned on the various stepped sections extending to outmost stepped section 74 which has bristles 92 at the greatest angle to the horizontal.

In operation, when first section 30 and second section 60 are mated together as previously described and as illustrated in FIG. 1, the angle broom 10 operates like a conventional angle broom when the bristles 50 and 92 are pushed along the surface to be swept by handle 56.

To convert the angle broom 10 into a whisk broom 94, the mating fasteners are separated. In the embodiment disclosed, first mating clip 88 and second mating clip 90 are squeezed inwardly to cause them to be moved out of their respective slots in housing 32 and the second section 60 is pulled away from first section 30. The second section can then be held by itself by holding onto handle 82 and the handheld section 94 is used as a whisk broom to sweep surfaces by hand.

To reassemble the broom and convert it back from a whisk broom to a full angle push broom, the mating member 86 is once again pushed into internal chamber 46 until mating clips 88 and 90 are once again retained in their respective open slots in the sidewalls 38 and 40 of housing portion 32 and first section 30.

This embodiment has been described with the receiver means 46, 48 and its parallel open slot in the first section and the mating members 86, 88 and 90 in the second section. It will be appreciated that it is within the spirit and scope of the present invention to have these joining means reversed so that receiving means are in the second section and mating means are in the first section.

Figures 3, 4:
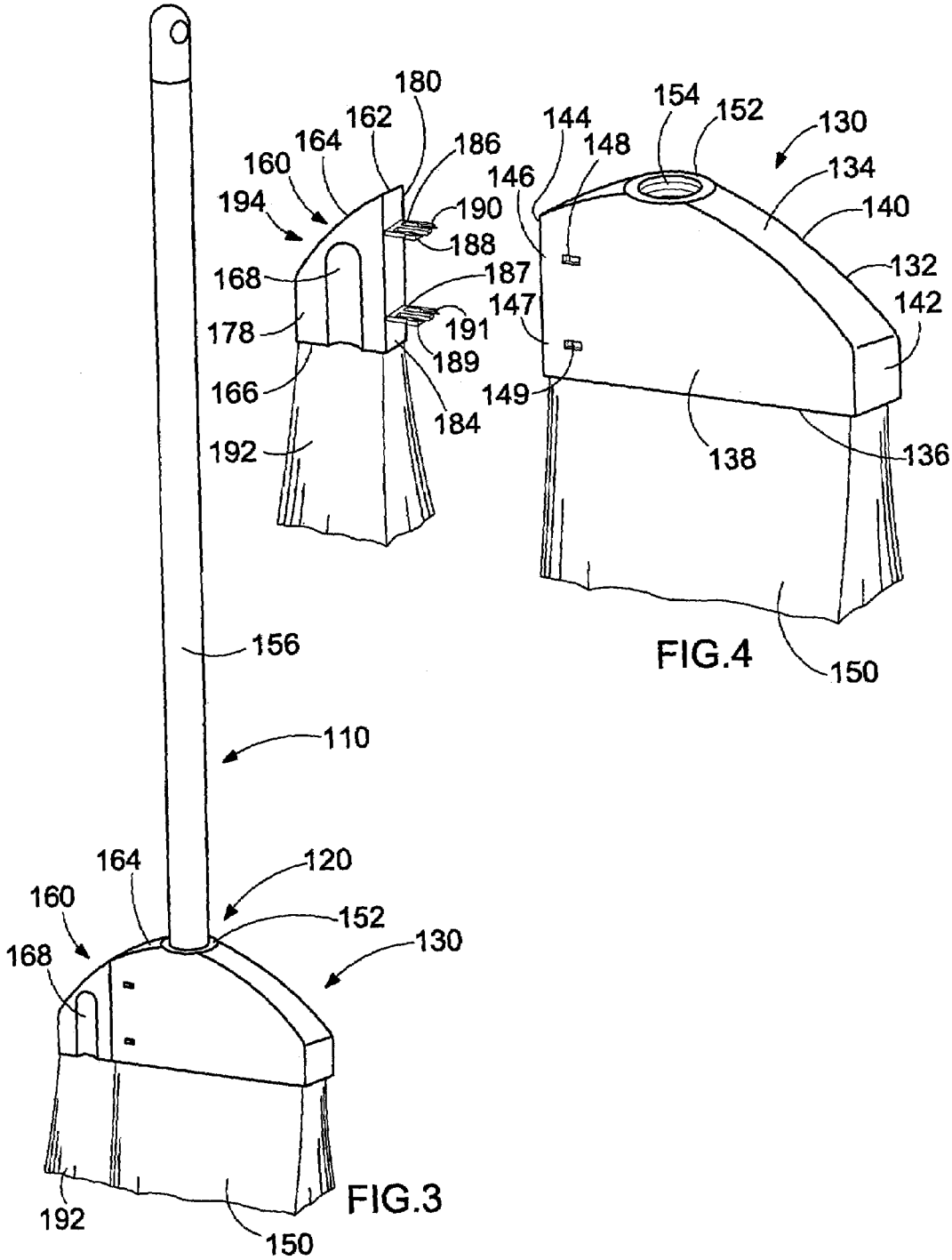
FIG. 3 is a perspective view of another embodiment of the present invention convertible broom embodied in a straight bristle push broom.
FIG. 4 is a perspective view of the separated sections of the embodiment of the convertible broom illustrated in FIG. 3, with the sections separated so that one section is used as a handheld straight bristle whisk broom.

The convertible feature of the present invention can also be incorporated into a straight push broom as illustrated in FIGS. 3 and 4. The convertible straight broom 110 includes a two piece housing 120 having a first section 130 and a second section 160. First section 130 includes an elongated housing portion 132 having a generally arcuate upper surface 134, a horizontally aligned lower surface 136, a first sidewall 138, a parallel second sidewall 140, a first closed outward end 142 and a parallel longer open interior second end 144, the open end leading to at least one internal chamber 146 with at least one first open slot 148.

Formed in said first sidewall 138 and leading to said at least one internal chamber 146 is first open slot 148. A corresponding parallel open slot is second sidewall 140, the corresponding parallel open slot also leading to at least one internal chamber 146. In the embodiment illustrated in FIGS. 3 and 4, there are two sets of parallel open slots in the respective sidewall, the open slots vertically aligned and spaced apart by a vertical distance on said sidewall. The open slot 148 is formed in said first sidewall 138 at a height closer to upper surface 134 than the lower open slot 149 in sidewall 138 which is aligned with open slot 148 and set below it by a given distance. The internal chamber 146 can extend the entire vertical interior distance within housing portion 142 in which lower open slot 149 also extends into internal chamber 146. Alternatively, internal chamber 146 may only extend into housing portion 132 at the location of open slot 148. In that case, a second internal chamber 147 will be located and extend into the housing portion 132 at the location of lower open slot 149 so that lower open slot 149 extends into second internal chamber 147. There is also a corresponding lower open slot in second sidewall 140 and the lower open slot in second sidewall 140 also extends into the same internal chamber that lower open slot 149 extends into.

The lower surface 136 of housing portion 132 retains a multiplicity of straight bristles 150 within the lower surface 136. The upper surface 134 of housing portion 132 contains a handle base 152 having threaded receiving means 154 to receive the lower end of the broom handle 156.

Second section 160 of two piece housing 120 includes a second housing portion 162 having upper surface 164 and a lower surface 166. Second section housing portion 162 includes a first sidewall 178 having a vertically extending groove 168 therein. Second section housing portion 162 also has a parallel oppositely disposed second sidewall 180 which also has a vertically extending groove therein which is aligned with and corresponds to groove 168.

Groove 168 and its corresponding aligned vertical groove in second sidewall 180 serves as a handle so that second section 160 can be grasped between the thumb and the forefinger of one hand when second section 160 is separated from first section 130.

Oppositely disposed interior end 184 of housing 162 supports at least one horizontally disposed male mating member 186 which has male clips to mate with an aligned pair of open slots in housing portion 132 of first section 130. In operation, male mating member 186 is inserted into internal chamber 146 of housing portion 132 so that first mating clip 188 protrudes through first open slot 148 and second mating clip 190 protrudes through its corresponding second open slot in second parallel sidewall 140.

In the event there is the second lower slot 149 and its corresponding lower slot in the second parallel side 140 and their second lower internal chamber 147 with which they are in communication, then the oppositely disposed interior end 184 will support a second lower mating member 187 which has male clips to mate with the aligned lower pair of slots in housing portion 132 of first section 130. In operation, while the first mating member 186 and its mating clip 188 and 190 are inserted into internal chamber 146, simultaneously, second mating member 187 is inserted into lower internal chamber 147 and male mating clip 189 is inserted through lower slot 149 and oppositely disposed male mating clip 191 is inserted into the corresponding lower slot in second parallel sidewall 140.

Lower surface 166 of second housing portion 162 supports a multiplicity of straight bristles 192.

This embodiment has been described with the receiving means 146, 148 and its parallel open slot and 147, 149 and its parallel open slot in the first section and the mating members 186, 188, 190, 187, 189 and 191 in the second section. It will be appreciated that it is within the spirit and scope of the present invention to have these joining means reversed so that the receiving means are in the second section and the mating members are in the first section.

In operation, when first section 130 and second section 160 are mated together as previously described and illustrated in FIG. 3, the broom 110 operates like a conventional broom when the bristles 150 and 192 are pushed or swept along the surface to be swept by handle 156.

To convert the straight broom 110 into a whisk broom 194, the mating fasteners are separated. In the embodiment disclosed, first upper mating clip 188 and second upper mating clip 190 are squeezed inwardly and simultaneously, first lower mating clip 189 and second lower mating clip 191 are squeezed inwardly, to cause them to be moved out of their respective slots in housing 132 and the second section 160 is pulled away from the first section 130. Second section 160 can then be held by itself by holding the second section by having the thumb pressed into groove 168 and the forefinger pressed into the corresponding aligned mating groove in the second parallel sidewall 180 and the handheld section 194 is used as a whisk broom to sweep surfaces by hand.

To reassemble the broom and convert it back from a whisk broom to a full straight broom, the mating members 186 and 187 are once again pushed into respective internal chambers 146 and 147 until the mating clips 188, 190, 189 and 191 are once again retained in their respective open slots in the sidewalls 138 and 140 of housing portion 132 of first section 130.

Defined in detail, the present invention is a convertible angle broom, comprising: (a) a two piece housing having a first section and a second section; (b) the first section having a housing portion comprising an upper surface, a horizontal lower surface, a first sidewall, a second sidewall parallel to the first sidewall, a first outer closed end and a parallel interior open second end, an internal chamber extending from the interior open second end into at least a portion of the interior of the housing portion, a first open slot in the first sidewall and in communication with the internal chamber and a second open slot in the parallel second sidewall also in communication with the internal chamber, the first and second open slots being parallel and aligned with each other; (c) a multiplicity of straight bristles retained by the horizontal lower surface of the housing portion of the first section; (d) a handle base retained on the upper surface of the housing portion of the first section, the handle base having receiving means to retain an elongated handle of the angle broom and an elongated handle retained therein; (e) the second section having a housing portion comprising an upper surface, a lower surface having a multiplicity of stepped sections at various angles, the angles to the horizontal increase from the step sections adjacent an interior end of the housing to the stepped section adjacent an outermost end of the housing, the housing having a first sidewall and a parallel second sidewall; (f) the housing portion of the second section further comprising an interior end positioned adjacent the interior end of the housing of the first section, a mating member supported on the interior end of the housing member of the second section, the mating member having a first clip and a second clip; (g) the housing further comprising an outer end which retains an arcuate handle thereon which handle extends over a portion of the upper surface of the housing portion of the second section; and (h) a multiplicity of bristles retained on the lower stepped surface of the housing portion of the second section, with the angle of the bristles to the horizontal increasing from the interior end to the exterior outer end; (i) whereby, the mating member on the second section is inserted into the chamber on the first section and the first and second clip members are respectively retained in the open slots of the first section, the first and second sections are joined to form an angle broom and when pressure is exerted on the clip members to push them into the internal chamber, the second section is pulled away from the first section and the second section is grasped by its handle to act as an angled whisk broom.

Defined broadly, the present invention is a convertible angle broom, comprising: (a) a two piece housing having a first section and a second section; (b) the first section having a housing portion comprising an upper surface, a lower surface, a first sidewall, a second sidewall parallel to the first sidewall, a first outer closed end and a first interior end having first retaining means;

(c) a multiplicity of bristles retained by the horizontal lower surface of the housing portion of the first section; (d) means to retain an elongated handle on the upper surface of the first section and an elongated first handle retained therein; (e) the second section having a housing portion comprising an upper surface, a lower surface with at least one stepped section at an angle to the horizontal, the housing having a first sidewall and a second sidewall; (f) the housing portion of the second section further comprising an interior end positioned adjacent the interior end of the housing of the first section, a mating retaining member supported on the interior end of the housing member of the second section, the mating member retaining member removably attachable to the first retaining means in the first section; (g) a second handle retained on the second section; and (h) a multiplicity of bristles retained on the lower stepped surface of the second section, at least some of the bristles being oriented at an angel to the horizontal; (i) whereby, when the first and second sections are joined together by the mating retaining member and the first retaining means, the broom operates as a conventional push broom and when the first and second sections are separated by disengaging the mating retaining member from the first retaining means, the second section is operated as an angled whisk broom.

Defined more broadly, the present invention is a convertible angle broom, comprising:

(a) a two piece housing having a first section and a second section; (b) the first section having a housing portion having means to retain an elongated handle, means to retain a multiplicity of bristles, and a first joining means; (c) a multiplicity of bristles retained by the housing portion of the first section and an elongated handle retained by the housing portion of the first section; (d) the second section having a housing portion having means to retain a handle, means to retain a multiplicity of bristles and a second joining means; and (e) the first and second sections aligned so that first joining means is aligned with the second joining means to removably attach the first section to the second section; (f) whereby, when the first and second joining means are connected, the first and second sections are attached and the broom operates as a conventional broom by being swept by the elongated handle, and when the first and second joining means are separated, the second section operates as a whisk broom.

Defined even more broadly, the present invention is a convertible broom, comprising: (a) a two piece housing having a first section and a second section; (b) the first section having a housing portion comprising an upper surface, a horizontal lower surface, a first sidewall, a second sidewall parallel to the first sidewall, a first outer closed end and a parallel interior open second end, at least one internal chamber extending from the interior open second end into at least a portion of the interior of the housing portion, a first open slot in the first sidewall and in communication with the at least one internal chamber and a second open slot in the parallel second sidewall also in communication with the at least one internal chamber, the first and second open slots being parallel and aligned with each other; (c) a multiplicity of straight bristles retained by the horizontal lower surface of the housing portion of the first section; (d) a handle base retained on the upper surface of the housing portion of the first section, the handle base having receiving means to retain an elongated handle of the broom and an elongated handle retained therein; (e) the second section having a housing portion comprising an upper surface, a horizontal lower surface, the housing having a first sidewall and a parallel second sidewall; (f) the housing portion of the second section further comprising an interior end positioned adjacent the interior end of the housing of the first section, a mating member supported on the interior end of the housing member of the second section, the mating member having a first clip and a second clip; (g) the housing further comprising grasping means incorporated into the first and second sidewall of the housing portion of the second section; and (h) a multiplicity of bristles retained on the lower surface of the housing portion of the second section; (i)

whereby, the mating member on the second section is inserted into the at least one chamber on the first section and the first and second clip members are respectively retained in the open slots of the first section, the first and second sections are joined to form a broom and when pressure is exerted on the clip members to push them into the internal chamber, the second section is pulled away from the first section and the second section is grasped by its grasping means to act as a whisk broom.

Defined even more broadly, the present invention is a convertible broom, comprising: (a) a two piece housing having a first section and a second section; (b) the first section having a housing portion comprising an upper surface, a lower surface, a first sidewall, a second sidewall, a first outer closed end and a first interior end having at least one first retaining means; (c) a multiplicity of bristles retained by the horizontal lower surface of the housing portion of the first section; (d) means to retain an elongated handle on the upper surface of the first section and an elongated handle retained therein; (e) a second section having a housing portion comprising an upper surface, a lower surface, a first sidewall and a second sidewall; (f) the housing portion of the second section further comprising an interior end positioned adjacent the interior end of the housing of the first section and at least one mating retaining member supported on the interior end of the housing member of the second section, the at least one mating retaining member removably attachable to the first retaining means in the first section; (g) a grasping means formed into the first and second sidewall of the second section; and (h) a multiplicity of bristles retained on the lower surface of the second section; (i) whereby, when the first and second sections are joined together by theat least one mating retaining member and the at least one first retaining means, the broom operates as a conventional broom and when the first and second sections are separated by disengaging the at least one mating retaining member from the at least one retaining means, the second section is operated as a whisk broom.

Defined even more broadly, the present invention is a convertible broom, comprising: (a) a two piece housing having a first section and a second section; (b) the first section having a housing portion having means to retain an elongated handle, means to retain a multiplicity of bristles, and at last one joining means; (c) a multiplicity of bristles retained by the housing portion of the first section and an elongated handle retained by the housing portion of the first section; (d) the second section having a housing portion having means to grasp the second section, means to retain a multiplicity of bristles and at least one joining means; and (e) the first and second sections aligned so that the joining means on the sections are aligned to removably attach the first section to the second section; (f) whereby, when the joining means in the first and second sections are connected, the first and second sections are attached and the broom operates as a conventional broom by being swept by the elongated handle, and when the joining means are separated, the second section operates as a whisk broom.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A convertible angle broom, comprising:

a. a two piece housing having a first section and a second section;

b. said first section having a housing portion comprising an upper surface, a horizontal lower surface, a first sidewall, a second sidewall parallel to said first sidewall, a first outer closed end and a parallel interior open second end, an internal chamber extending from said interior open second end into at least a portion of the interior of the housing portion, a first open slot in said first sidewall and in communication with said internal chamber and a second open slot in said parallel second sidewall also in communication with said internal chamber, the first and second open slots being parallel and aligned with each other;

c. a multiplicity of straight bristles retained by said horizontal lower surface of said housing portion of said first section;

d. a handle base retained on said upper surface of said housing portion of said first section, the handle base having receiving means to retain an elongated handle of the angle broom and an elongated handle retained therein;

e. said second section having a housing portion comprising an upper surface having a horizontal surface on its innermost portion adjacent the first section, and then tapering to an angle until it converts to an outermost horizontal portion, the outermost horizontal portion positioned lower than the innermost horizontal portion, a lower surface having a multiplicity of stepped sections at various angles, the angles to the horizontal increase from the step sections adjacent an interior end of the housing to the stepped section adjacent an outermost end of the housing, the housing having a first sidewall and a parallel second sidewall;

f. said housing portion of said second section further comprising an interior end positioned adjacent the interior end of the housing of said first section, a mating member supported on said interior end of the housing member of the second section, the mating member having a first clip and a second clip;

g. said housing further comprising an outer end which retains an arcuate handle thereon which handle extends over a portion of the upper surface of the housing portion of said second section including the outermost horizontal portion the angled portion, and over part of the innermost horizontal portion;

h. a multiplicity of bristles retained on the lower stepped surface of the housing portion of the second section, with the angle of the bristles to the horizontal increasing from the interior end to the exterior outer end; and i. said mating member on said second section is inserted into said chamber on said first section and said first and second clip members are respectively retained in the open slots of said first section, the first and second sections are joined to form an angle broom and when pressure is exerted on said clip members to push them into the internal chamber, the second section is pulled away from the first section and the second section is grasped by its handle to act as an angled whisk broom.

2. A convertible broom, comprising:

a. a two piece housing having a first section and a second section;

b. said first section having a housing portion comprising an upper surface, a horizontal lower surface, a first sidewall, a second sidewall parallel to said first sidewall, a first outer closed end and a parallel interior open second end, said interior open end of an first section having a pair of vertically spaced apart upper and lower internal chambers extending from said interior open end into at least a portion of the interior of the housing portion, a first upper open slot in said first sidewall and in communication with the upper internal chamber and a second upper open slot in said parallel second sidewall also in communication with said upper internal chamber, the first and second upper open slots being parallel and aligned with each other, a first lower open slot in said first sidewall and in communication with the lower internal chamber and a second lower open slot in said parallel second sidewall also in communication with said lower internal chamber, the first and second lower open slots being parallel and aligned with each other; and c. a multiplicity of straight bristles retained by said horizontal lower surface of said housing portion of said first section;

d. a handle base retained on said upper surface of said housing portion of said first section, the handle base having receiving means to retain an elongated handle of the broom and an elongated handle retained therein;

e. said second section having a housing portion comprising an upper surface, a horizontal lower surface, the housing having a first sidewall and a parallel second sidewall;

f. said housing portion of said second section further comprising an interior end positioned adjacent the interior end of the housing of said first section, an upper mating member supported on said interior end of the housing member of the second section, the upper mating member having a first upper clip and a second upper clip to be respectively received in the first and second upper slots of said first sidewall, a lower mating member supported on said interior end of the housing member of the second section, the lower mating member having a first lower clip and a second lower clip to be respectively received in the first and second lower slots of said first sidewall;

g. the first and second section are joined when the upper mating member is received in the upper internal chamber and lower mating member is received in the lower internal chamber and the sections are separated by simultaneous squeezing pressure on the upper and lower set of clips;

h. said housing further comprising grasping means incorporated into said first and second sidewall of the housing portion of said second section; and i. a multiplicity of bristles retained on the lower surface of the housing portion of the second section;

j. whereby, said mating members on said second section are respectively inserted into said respective chambers on said first section and said respective upper and lower first and second clip members are respectively retained in the upper and lower open slots of said first section, the first and second sections are joined to form a broom and when pressure is exerted on said clip members to push them into the internal chamber, the second section is pulled away from the first section and the second section is grasped by its grasping means to act as a whisk broom.

* * * * *